US007658037B2

(12) United States Patent
Bucher et al.

(10) Patent No.: US 7,658,037 B2
(45) Date of Patent: Feb. 9, 2010

(54) VARIABLE VOLUME CONTAINER UNIT HOISTING DEVICE FOR LOWERING AND RAISING A TELESCOPABLE EXPANSION ELEMENT

(75) Inventors: Hubert Bucher, Deggenhauser Tal (DE); Andreas Serden, Meersburg (DE)

(73) Assignee: EADS Deutschland GmbH, Friedrichshafen (DE)

( * ) Notice: Subject to any disclaimer, the term of this patent is extended or adjusted under 35 U.S.C. 154(b) by 604 days.

(21) Appl. No.: 10/834,136

(22) Filed: Apr. 29, 2004

(65) Prior Publication Data

US 2005/0120639 A1 Jun. 9, 2005

(30) Foreign Application Priority Data

Dec. 3, 2003 (DE) ..... 103 56 454
Feb. 14, 2004 (DE) ..... 10 2004 007 297

(51) Int. Cl.
*E04B 1/344* (2006.01)

(52) U.S. Cl. ..... 52/67; 52/68

(58) Field of Classification Search ..... 52/64, 52/65, 67–69, 71; 220/1.5, 4.03, 8; 296/165, 296/171, 173, 175
See application file for complete search history.

(56) References Cited

U.S. PATENT DOCUMENTS 2,780,843 A * 2/1957 De Sherbinin ..... 52/69
2,831,722 A * 4/1958 Hanson et al. ..... 296/172
3,653,165 A * 4/1972 West ..... 52/67
3,719,386 A * 3/1973 Puckett et al. ..... 296/26.13
4,741,133 A * 5/1988 Kutzner ..... 52/79.5
4,829,726 A * 5/1989 de Potter d'Indoye ..... 52/66
5,577,351 A * 11/1996 Dewald et al. ..... 52/67
5,620,224 A * 4/1997 DiBiagio et al. ..... 296/26.13
5,706,612 A * 1/1998 Tillett ..... 52/67
5,761,854 A * 6/1998 Johnson et al. ..... 52/69
5,815,988 A * 10/1998 Molina ..... 52/67
5,950,372 A * 9/1999 Al-Sabah et al. ..... 52/66
6,003,919 A * 12/1999 Shook ..... 296/26.14
6,052,952 A * 4/2000 Frerichs et al. ..... 52/64

(Continued)

FOREIGN PATENT DOCUMENTS

DE 8905818 * 6/1989

(Continued)

*Primary Examiner*—Gay Ann Spahn
(74) *Attorney, Agent, or Firm*—Crowell & Moring LLP

(57) ABSTRACT

A container is constructed to have a variable volume, wherein a basic container has a bottom panel and a roof panel, one or more hinged side panels are rotateable about a horizontal axis, and one or more expansion elements are telescopeable out of the basic container and having a bottom panel, a side open toward a front the basic container and a front panel opposite the open side. The one expansion element(s) is/are open toward the top and, in a telescoped state, the roof panel is formed by a raised side panel of the basic container. One or more hoisting devices is associated with each expansion element and with which the expansion element is lowerable. Thereby, after the one or more expansion elements are telescoped out, the bottom panels of the expansion element(s) and of the basic container are at the same height and also so that the expansion element(s) is insertable back into the basic container after being lowered. The hoisting device(s) is/are configured to act on the hinged side panel to lower and raise the at least one expansion element.

2 Claims, 17 Drawing Sheets

U.S. PATENT DOCUMENTS

| | | | | |
|---|---|---|---|---|
| 6,202,362 | B1 * | 3/2001 | McManus et al. | 52/67 |
| 6,223,479 | B1 * | 5/2001 | Stockli | 52/68 |
| 6,772,563 | B2 * | 8/2004 | Kuhn | 52/67 |
| 7,290,372 | B2 * | 11/2007 | Aust et al. | 52/67 |
| 7,316,439 | B1 * | 1/2008 | Crean et al. | 296/26.13 |
| 2001/0008059 | A1 * | 7/2001 | McManus et al. | 52/67 |
| 2003/0056446 | A1 * | 3/2003 | Napier | 52/66 |
| 2003/0213185 | A1 * | 11/2003 | Findley | 52/67 |
| 2005/0122014 | A1 * | 6/2005 | Bucher et al. | 312/311 |
| 2006/0254159 | A1 * | 11/2006 | Trautman et al. | 52/64 |

FOREIGN PATENT DOCUMENTS

| | | | |
|---|---|---|---|
| DE | 3911511 | * | 11/1990 |
| DE | 9216314.9 | U1 | 1/1993 |
| DE | 9216314 | U1 | 1/1993 |
| DE | 9408060 | * | 9/1994 |
| DE | 0682156 | A1 | 11/1995 |
| DE | 4429927 | * | 11/1995 |
| DE | 10135226 | A1 | 2/2003 |
| DE | 10135226 | A1 | 2/2003 |
| EP | 0682156 | * | 11/1995 |
| EP | 0682156 | B2 | 4/2004 |
| FR | 983214 | * | 6/1951 |
| FR | 2475505 | * | 8/1981 |
| GB | 1524253 | * | 9/1978 |
| WO | 9851875 | A1 | 11/1998 |

* cited by examiner

VARIABLE VOLUME CONTAINER UNIT HOISTING DEVICE FOR LOWERING AND RAISING A TELESCOPABLE EXPANSION ELEMENT

BACKGROUND OF THE INVENTION

This application claims the priority of DE 103 56 454.3, filed Dec. 3, 2003, the disclosure of which is expressly incorporated by reference herein.

The present invention relates to an expandable container, e.g., according to ISO standards, in particular as a working space, also known as shelters in English-speaking countries.

For example, an expandable container is described in German Utility Model 92 16 314.9 and includes a basic container with hinged side panels and one or more expansion elements that can be telescoped out of the basic container. An expansion element includes two side panels and a front panel. In the condition with the expansion element telescoped out, two side panels swung out on the basic container form the roof panel and the bottom panel of an expansion element. One disadvantage of this embodiment is the great sealing lengths required to seal the container along the roof panel and the bottom panel. This is a problem in particular with regard to the requirement for ABC tightness.

Another expandable container is known from EP 0 682 156 B1. This includes a basic container and one or more expansion element, which can be telescoped out of the basic container to expand the interior. The expansion elements are box-shaped and except for the side open toward the basic container are closed on all sides. To achieve a flat bottom inside the entire container, a hoisting device is provided to lower the expansion elements to such an extent that after being lowered, the bottom panels of the basic container and of the expansion element are at the same level. In the embodiment having two expansion elements, the dimensions of the two expansion elements must be selected so that the one expansion element can be retracted into the other expansion element.

DE 101 35 226 A1 describes a generic expandable container having a hoisting device to achieve a flat bottom. The expansion elements can be lowered with this hoisting device, so that after being lowered, the bottom panels of the basic container and the expansion element are at the same level. The expansion elements are open at the top. The basic container has a side panel that is hinged about a horizontal axis and forms the roof panel of an expansion element when said expansion element is telescoped out. An improved standing height in an expansion element can be achieved with this construction.

SUMMARY OF THE INVENTION

An object of the present invention is to create an expandable container, which has first an adequate standing height even in the expansion elements and second has an easy-to-operate and mechanically sturdy hoisting device.

This object has been achieved by providing a hoisting device which acts on the hinged side panel to lower and raise an expansion element.

According to the present invention, a mechanism which is already present on the container, i.e. one side panel of the basic container, can be pivoted about a horizontal axis so that when raised, it can also be used as a roof panel of an expansion element to lower the expansion elements, so that a uniform bottom level is obtained in the entire container. To this end, a hoisting device is configured as a linear actuator in particular to act on the hinged side panel. This linear actuator may support itself both on the basic container and on the foundation on which the container is located.

To prevent tilting of the expansion element in the pivoting movement of the side panel created by the hoisting device, an equalizing device is provided in a currently preferred embodiment of this invention. This permits parallel lowering, i.e., without tilting the expansion element out of the vertical. The bottom of the expansion element remains horizontal during this lowering operation.

In a further embodiment, an expansion element has multiple upper and multiple lower sliding or rolling elements, e.g. rollers, on its inner end (i.e., the end which comes to rest neighboring the basic container when the expansion element is telescoped). Furthermore, the basic container has multiple guide elements assigned to the upper sliding or rolling elements, the elements having ramps slanting downward toward the expanded expansion element on its end neighboring the relevant expansion element (when the expansion element is telescoped). In addition, the basic container has multiple lower stop, assigned to the sliding or rolling lower elements in the form of vertical profile strips, e.g., on its end neighboring the expansion element (when the expansion element is telescoped). If the expansion element is telescoped completely, it assumes a statically fixed, stable position in which the lower sliding or rolling elements stop on the assigned lower stops and the upper sliding or rolling elements rest on the ramps of the guide elements. This stable position forms the starting position for lowering the expansion element by actuating the hoisting device.

DETAILED DESCRIPTION OF THE DRAWINGS

Figure 1A:
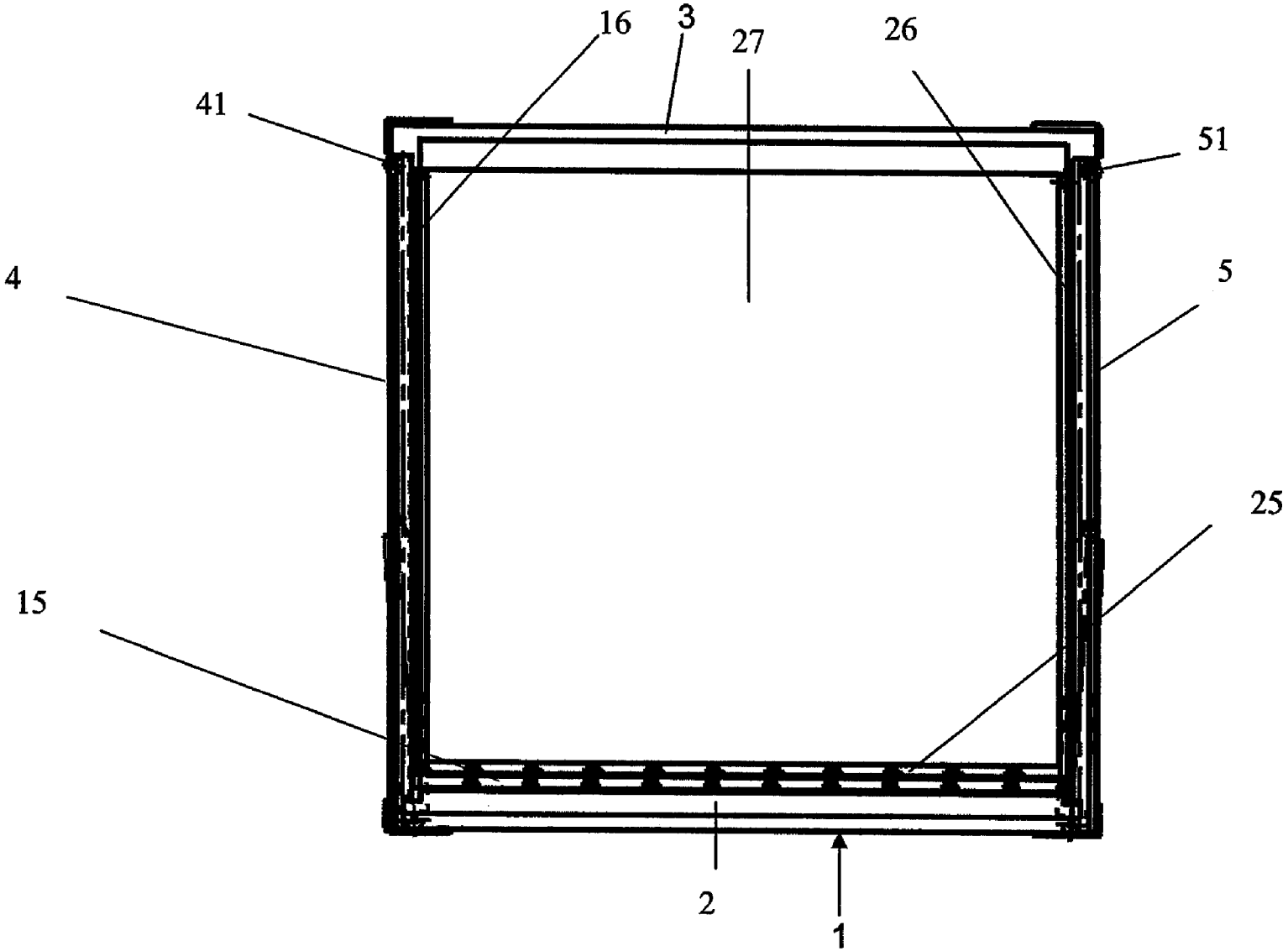
FIGS. 1 *a*) through *e*) are elevational, cross-sectional schematic views showing the sequence of unfolding a container according to the present invention in five steps.
Figure 1B:
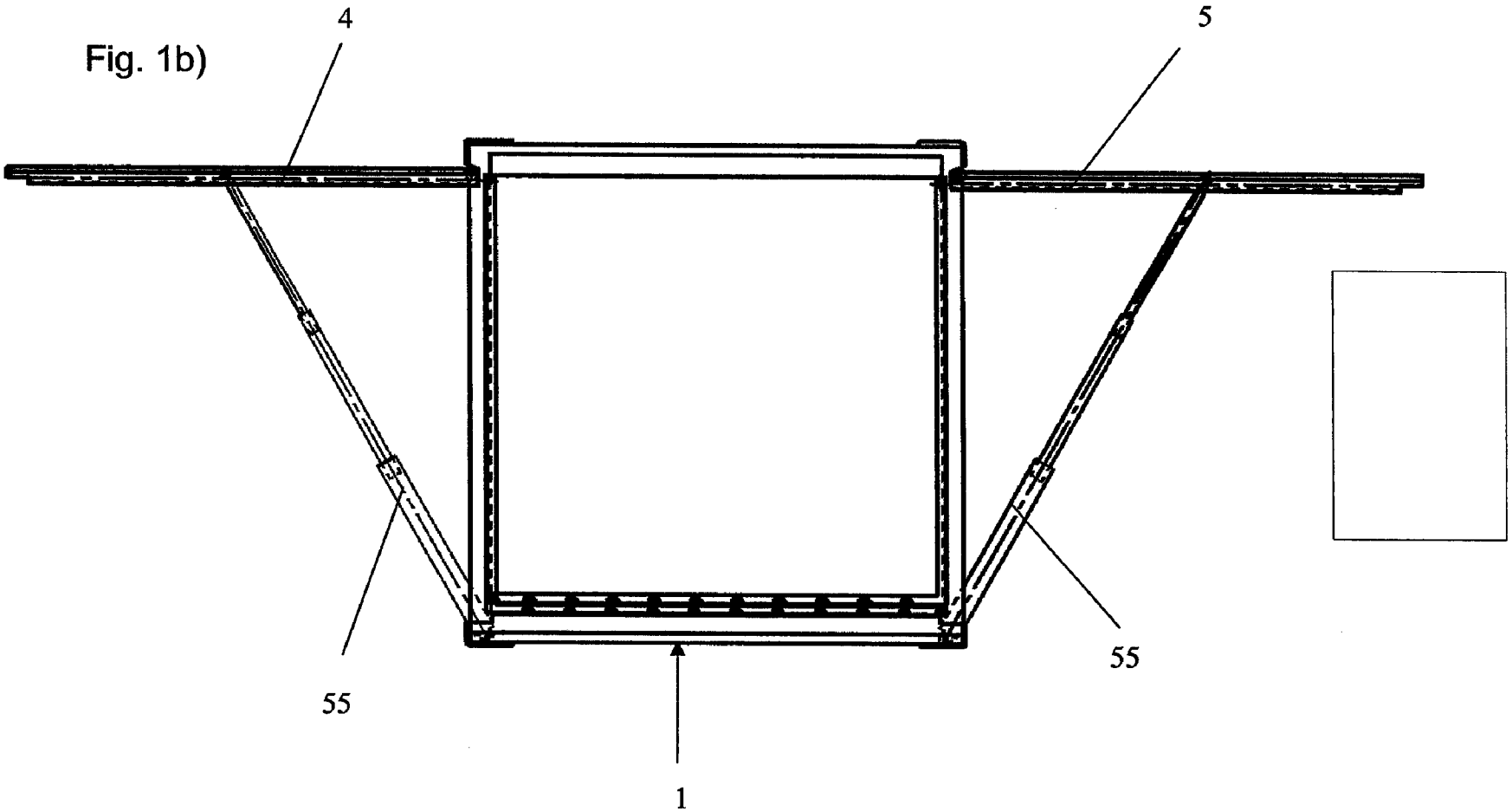
Figure 1C:
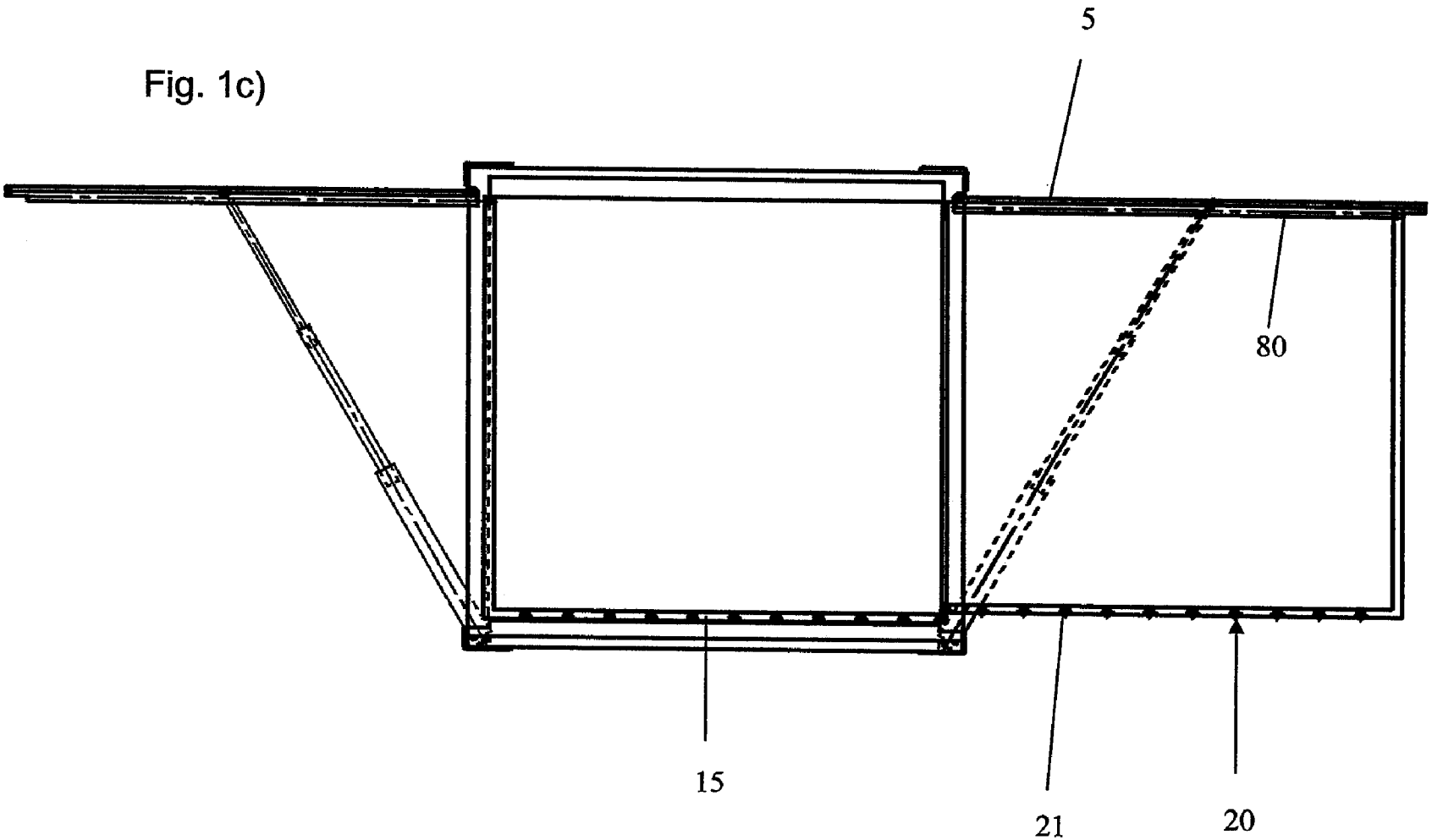
Figure 1D:
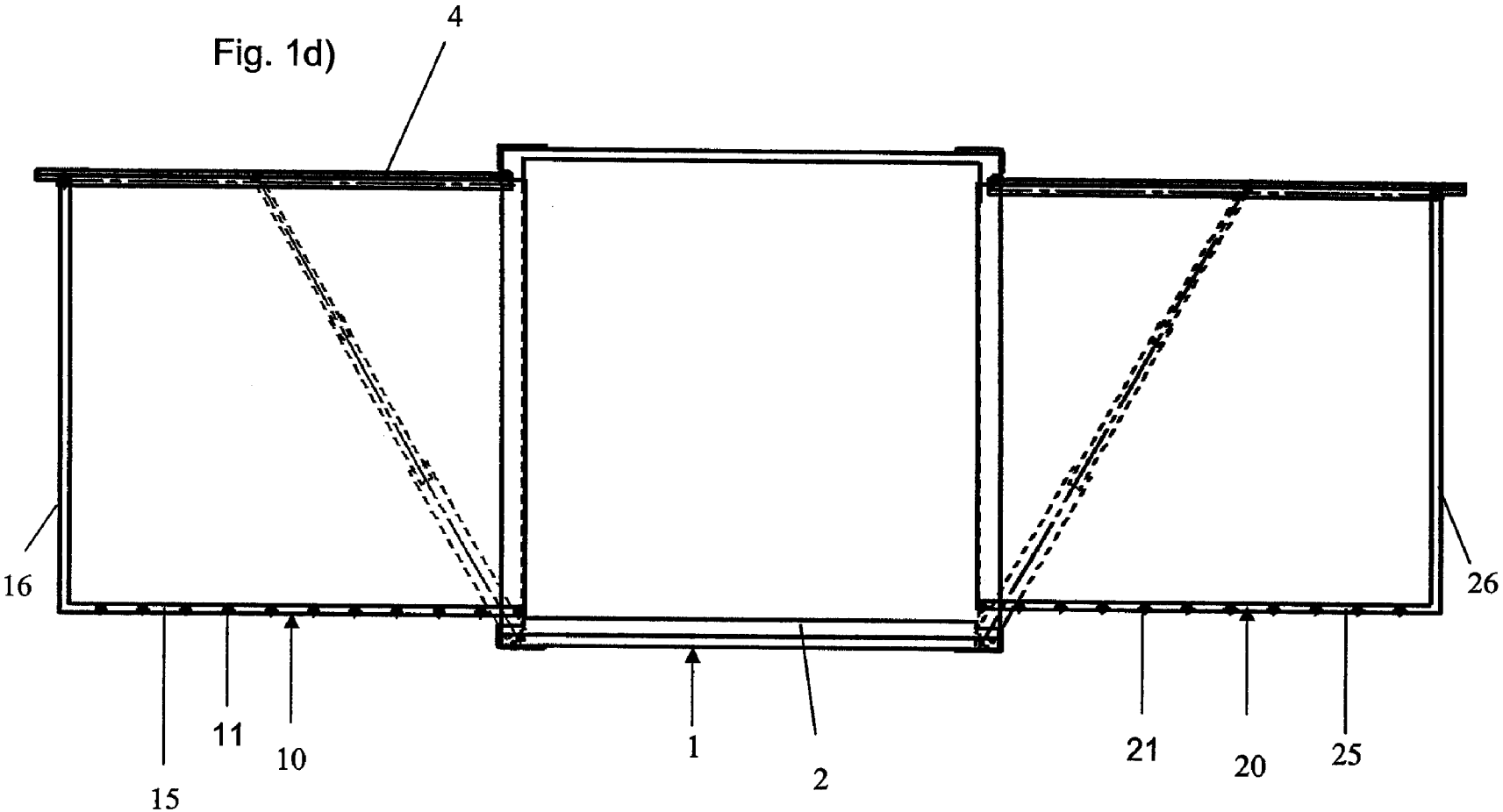

FIGS. 1 *a*) through *e*) show the individual steps in construction of an expandable container according to the present invention having two expansion elements 10, 20. FIG. 1 *a*) shows the starting state (i.e., shipping state). The box-shaped basic container 1 contains the two expansion elements 10, 20 (see FIG. 1 *d*)). The expansion element 20 is retracted into the expansion element 10 which is slightly larger with regard to length and height. A bottom panel 15, 25 and front panel 16, 26 of the two expansion elements 10, 20 and a side panel 27 of the interior expansion element 20 can be seen on each side. The basic container 1 has a bottom panel 2, a roof panel 3 and two hinged side panels 4, 5, each of the hinged panels mounted to rotate about a horizontal axis 41, 51 on the upper edge of a container panel.

In FIG. 1 *b*) the two hinged side panels 4, 5 have been raised up and are now essentially in one horizontal plane. The side surface of the basic container 1 and the raised side panel 4, 5 form a right angle. In this position, the raised side panels 4, 5 are supported on a support 55 in the form of a (linear actuator) which is variable in length and is arranged with its other end on the basic container 1. The support 55 can be configured, for example, as a telescopable hoisting cylinder (e.g., hydraulic, pneumatic, electro-mechanical).

FIG. 1 *c*) shows the smaller expansion element 20 already completely extracted. This is accomplished by rollers 23, 24 provided on the expansion element 20 (FIG. 3) in the upper area of the side panel of an expansion element. These rollers engage in the guide rails 80 (see also FIG. 2) which are provided on the raised side panel 5. Two guide rails are advantageously provided for each expansion element. In addition, the bottom area of the expansion element 10, 20 has additional rollers 21 which roll on the bottom panel 15 of the larger expansion element 10 when telescoped out. When raised, the side panel 5 of the basic container 1 then forms the roof panel of the expansion element 20. The raised side panel 4 or 5 is therefore also referred to below as a roof panel, depending on the context.

In FIG. 1 *d*), the larger expansion element 10 is also completely extracted via the guide rails 80 provided on the raised side panel 4. The two expansion elements were each telescoped out in the horizontal direction, i.e., without any change in the vertical. The bottom levels of the expansion element 10, 20 and the basic container 1 are thus different from one another, with the bottom level of the basic container 1 being the lowest and the bottom level of the small expansion element 20 being the highest. For example, the difference in level of the smaller expansion element from the basic container amounts to approx. 100 mm and the difference in level of the larger expansion element 10 from the basic container 1 amounts to approx. 50 mm.

FIG. 1 *e*) shows the completely unfolded container with the expansion elements 4, 5 lowered, so that now a uniform bottom level is established within the entire expanded container. To do so, the length of the support 55 assigned to the respective expansion element has been reduced (FIG. 1 *d*)). The roof panels 4, 5 are therefore mounted so they can rotate about the horizontal axis 41, 51 and are pivoted downward out of their horizontal position. In order to prevent tilting of the expansion element 20, which is connected to the roof panel 4,5 via the guide rails, according to a first embodiment of this invention, an equalizing device is provided, to be explained in detail later with reference to FIGS. 2 through 4. With a vertical change in position (due to the change in length of the support 55 of the exterior end of an expansion element, this equalizing device mediates or undergoes a preferably equally great vertical change in position of the end of the expansion element 10, 20, which is on the inside and adjacent the basic container 1. As a result, a parallel lowering may thus be achieved in which the bottom surface of the expansion element 10, 20 is oriented horizontally during the lowering operation and in particular is oriented horizontally on reaching the end position.

An important advantage is that only the respective hoisting device 55 need be operated in order to lower the bottom panel. The mechanism for achieving the parallel lowering is coupled to the movement of the hoisting device 55 and thus takes place automatically without any further external intervention.

Figure 2:
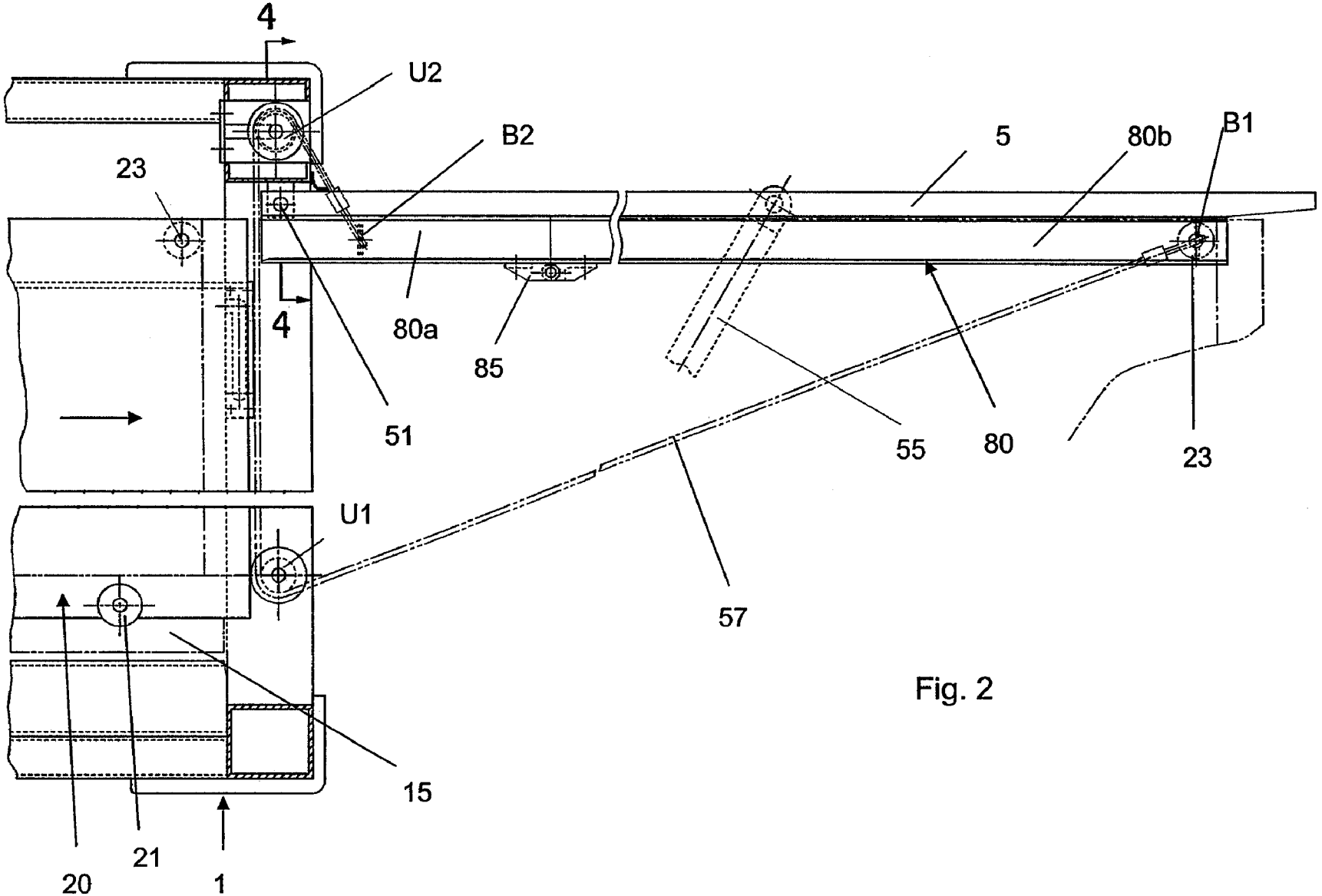
FIG. 2 is a vertical sectional view through a first embodiment of the container of the present invention having a retracted expansion element.

Reference is made to FIG. 2 for a more detailed explanation of the lowering mechanism according to the first embodiment of this invention. This figure illustrates a vertical section through a container according to the present invention showing the basic container 1 with an expansion element 20 completely retracted into it. The hinged side panel 5 of the basic container 1 has been raised from its vertical shipping state position to a horizontal position about the fulcrum 51. A guide rail 80 can be seen on the raised side panel 5. The guide rail is divided into two sections 80*a*, 80*b* which are connected by a hinge 85. By way of the hinge 85, the section 80*a* which is on the inside (i.e., adjacent to the basic container 1) can be rotated downward. The section 80*b*, which is on the outside (i.e., in the direction of the outer edge of the unfolded container), is rigidly connected to the side panel 5. On the upper edge of its associated side panel, the expansion element 20 has a roller 23 which engages in the guide rail 80 when the expansion element has been telescoped out. FIG. 2 shows this roller in dash lines in its starting position before the expansion element 20 is telescoped out. At the outer end of the guide rail, the end position of the roller is shown with dot-dash lines, with the expansion element 20 completely telescoped out. Another roller 24 is at the same height on the rear end (not shown in FIG. 2) of the expansion element (see FIG. 3).

In addition, the expansion element 20 has bottom rollers 21, which roll on the bottom panel 15 of the larger expansion element 10 when telescoped out. The longitudinally adjustable support 55 acts approximately in the middle of the raised side panel 5. At its other end, this support is supported on the basic container 1.

The equalizing device, which prevents the expansion element from tilting when lowered by the hoisting device 55, includes a cable 57, made, for example, of steel. It is connected at one end to the outer end of the guide rail 80 or, alternatively to the side panel 5. The cable 57 is guided over a pulley U1 in the lower area of the basic container 1 and from there over another pulley U2 in the upper area of the basic container 1 above the fulcrum 51 and is attached to the hinged section 80*a* of the guide rail 80 at fastening point B2.

The length of the cable is adjusted so that, with side panel 5 raised as shown in FIG. 2, the hinged section 80*a* of the guide rail 80 is aligned horizontally, with no bend in the hinge 85. The cable is advantageously acted upon by a tension device with a prestress. The expansion element 20 can then be telescoped out via the rollers 23, 24 (FIG. 3), which roll on the guide rails 80. With the expansion element 20 completely telescoped out, the two rollers 23, 24 come to rest in the area of the beginning and end, respectively, of the guide rail 80. One roller 23 thus comes to lie on section 80*b*, which is rigidly connected to the raised side panel 5, while the other roller 24 comes to lie on the section 80*a* of the guide rail that is folded down in relation to section 80*a*.

Figure 3:
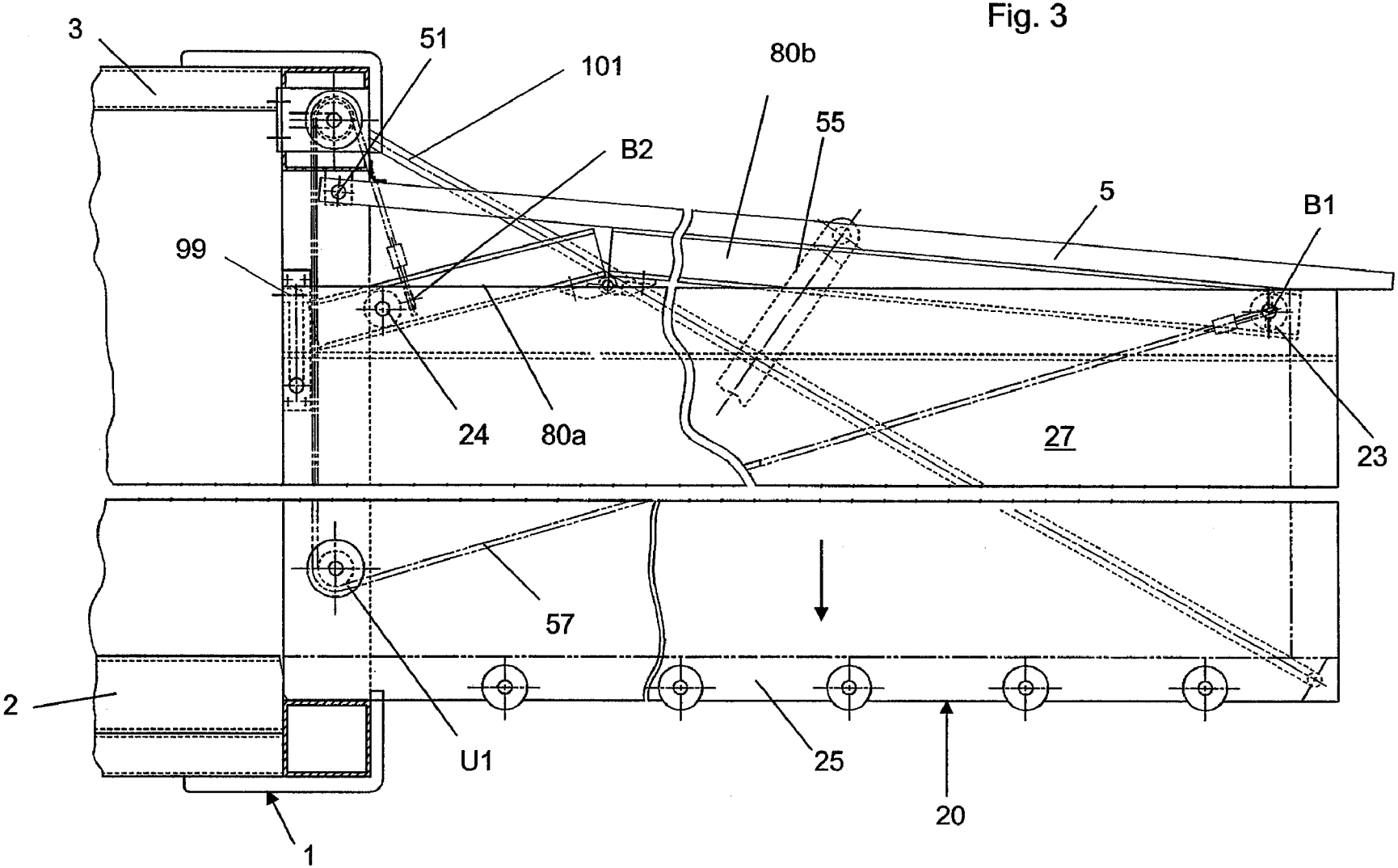
FIG. 3 is a vertical sectional view through the first embodiment of the container shown in FIG. 2 but having an expansion element telescoped out and lowered.

For lowering the expansion element 20, the hoisting device is operated, i.e., the length of the support 55 is reduced. The side panel 5 together with the side of the expansion element 20 on the outside pivots downward about the fulcrum 51. Due to the resulting change in distance of the fastening point B1 of the cable 57 from the lower pulley U1, a corresponding cable length is released on the other end of the cable. This results in the hinged section 80*a* of the guide rail 80 in which the one guide roller 24 of the expansion 20 engages, also being lowered downward together with the interior end of the expansion element 20. FIG. 3 shows the container in the state with the expansion element 20 telescoped out and lowered.

By adaptation, specifically (1) of the position of the lower pulley U1 in relation to the outer fastening point B1 of the cable 57, (2) of the position of the fastening point B2 of the cable 57 on the hinged section 80*a* of the guide rail, and (3) of the position of the hinge 85 for the pitch of the guide rail 80, the vertical change in position experienced by the exterior end of the expansion element 20 is made just equal to the vertical change in position experienced by the interior end of the expansion element 20. A strictly parallel lowering of the expansion element 20 can thus be achieved without it being tilted out of the horizontal. The bottom 25 of the expansion element is in a horizontal position during the entire lowering movement, in particular on reaching its end position.

The direction of movement of the expansion element 20 is essentially vertical at this stage. The horizontal movement executed by the expansion element 20 on the basis of the fact that the exterior end of the pivotable roof 5 is moving on a circular path about the axis 51 can be disregarded if the radius of the pivoting movement (e.g., the width of the expansion element 10, 20 in the case of ISO containers is several meters) and a typical objective of approx. 100 mm for the lowering are taken into account.

The lowering movement described above is completely reversible. In raising the expansion element 20, the above-described mechanism described here is run through in a reverse chronological sequence. For raising, the hoisting device 55 is actuated causing a change in length of the support. The roof panel 5 pivots upward about the axis 51. The resulting change in position of the fastening point B1 of the cable 57 on the outer end of the roof panel 5 results in the hinged section 80*a* of the guide rail 80 and thus the inside of the expansion element 20 being raised. A parallel raising thereby results without tilting out of the vertical. When the roof panel 5 has reached a horizontal position, the hinged section 80*a* of the guide rail 80 is in contact with the roof panel 5. The expansion element 20 can then be inserted into the basic container 1.

To ensure accurate vertical and parallel lowering in cases, additional guide devices 99 may be mounted on the basic container 1. They may be in the form of a rail running vertically, in which the pins 98 (FIG. 4), pegs or bolts that are connected to an expansion element 10, 20 engage.

Diagonal tension braces 101 can also be mounted for tension release of the actuator 55 when the expansion elements 10, 20 are telescoped out. In a particularly advantageous embodiment, the tension braces may be configured as cables, so as to be mounted permanently (when the expansion element is retracted as well as when it is telescoped out and also in the transitional phase) on the diagonally opposing mounting points between an expansion element 10, and the basic container 1.

When telescoped out, the cables 101 define the maximum horizontal telescoping path of an expansion element 10, 20. They also ensure correct alignment of the expansion element (no tilting of the expansion element out of the vertical) when the expansion element is completely lowered. When the expansion element is retracted, the cables 101 are in a niche between the side panel 27 of an expansion element and the basic container 1.

Figure 4:
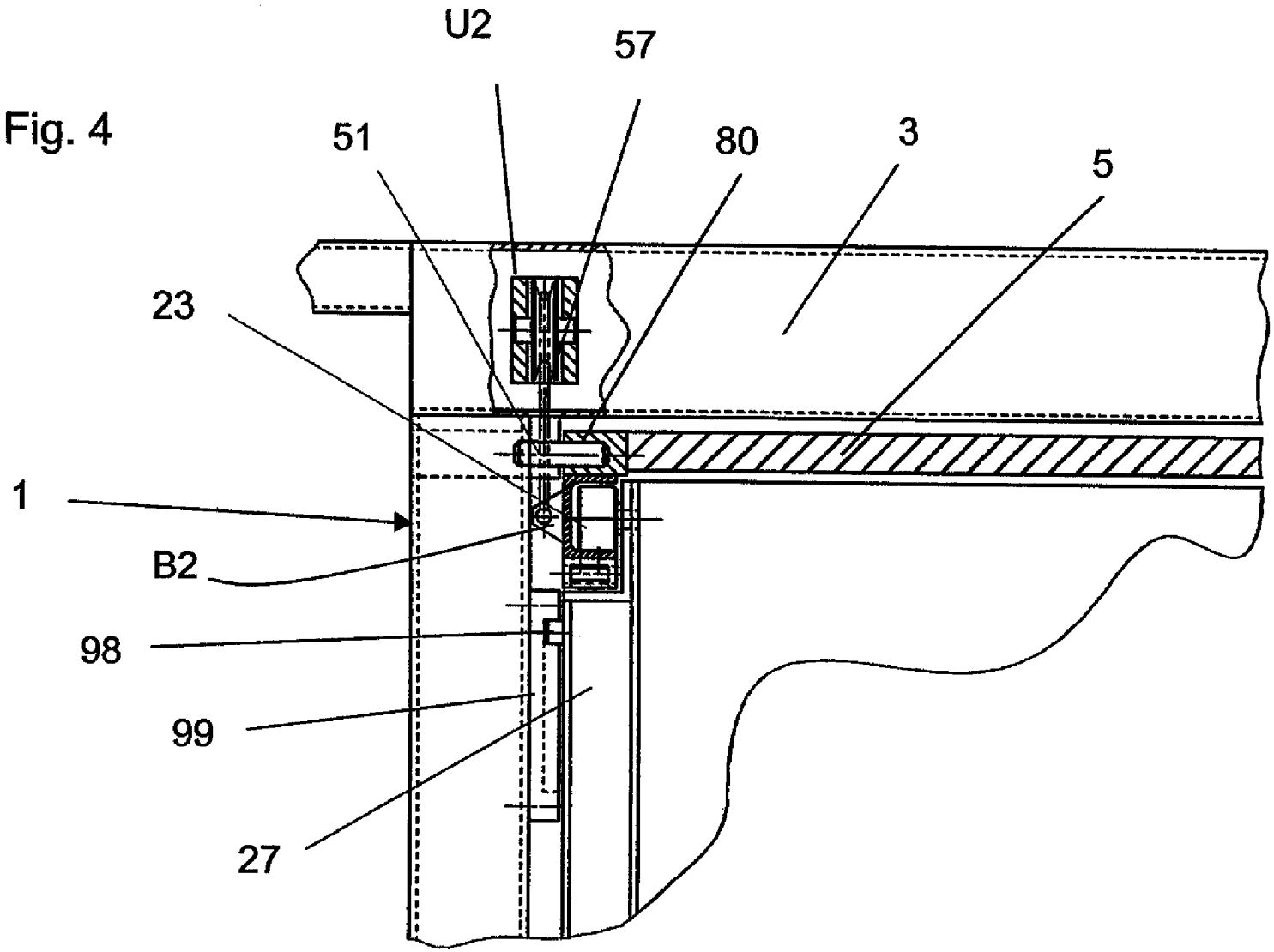
FIG. 4 is a sectional view along line 4-4 in FIG. 2.

FIGS. 5 through 8 show a second embodiment of the container according to the present invention which, in contrast to the first embodiment shown in FIGS. 2 through 4, a cable or other equalizing device is unnecessary for lowering the interior end of an expansion element.

The basic container 1 is shown in FIG. 5 with expansion element 20 telescoped out. The solid lines show the state before the expansion element 20 is lowered, the dashed lines show the state with the expansion element lowered. The hoisting device 55 is implemented, as in the first embodiment shown in FIGS. 2 through 4, as a linear actuator which acts on the hinged side panel 5 to achieve lowering and raising of the expansion element 20.

Two variations are shown in FIG. 5 with regard to the support of the linear actuator 55. According to the first variation, the actuator 55 is supported on the basic container 1. Alternatively, the actuator 55 can be supported on the foundation on which the container is located. Support of the hoisting device 55 on the foundation is also contemplated for the first embodiment of the container shown in FIGS. 2 through 4.

In the embodiment shown in FIG. 5, the two functions of (a) raising the side panel 5 from its vertical starting position (FIG. 1 *a*) into its horizontal position (FIG. 1 *b*)) around joint or fulcrum 51 (FIG. 6); and (b) lowering the expansion element 20 are also assigned to different hoisting devices. There is also a second linear actuator 56 which folds up the side panel and acts between the basic container 1 and the hinged side panel 5. The other hoisting device 55 is specifically responsible for the lowering and raising of the expansion element 20. In accordance with the different operating loads, the actuator 56 may be configured as weaker than the actuator 55. Such a division of the two functions to different hoisting devices is also contemplated in the first embodiment of the inventive container shown in FIGS. 2 through 4.

During telescoping, the expansion element 20 is guided in the guide rail 180 on precisely one point, namely roller 123. The expansion element is rotatable around a horizontal axis D on this point. This roller 123 is positioned in a region extending in the horizontal direction between the center of gravity S of the expansion element 20 and the exterior end of the expansion element 20.

The expansion element 20 also has an upper roller 201 and a lower roller 202 on its interior end neighboring the basic container. The two rollers 201, 202 are each attached via a shaft receiver 205 (FIG. 6) to a side panel of the expansion element 20. The upper roller 201 is associated with a guide element 211. The guide element 211 is positioned on the top of the basic container 1, on an end neighboring the expansion element 20. The element 211 has the shape of an angle with horizontally and vertically aligned legs and a ramp connecting the two legs, which ramp slopes down toward the expansion element 20. The ramp has a horizontal length of 10 mm in a typical embodiment. Preferred angles are in the range from 20 to 50 degrees in relation to the vertical.

The lower roller 202 is assigned a stop 212 positioned on the basic container 1 on its end neighboring the expansion element 20. The stop 212 has the shape of an essentially vertically running profile which runs over nearly the entire height of the basic container 1 in this illustrated embodiment.

Figure 5A:
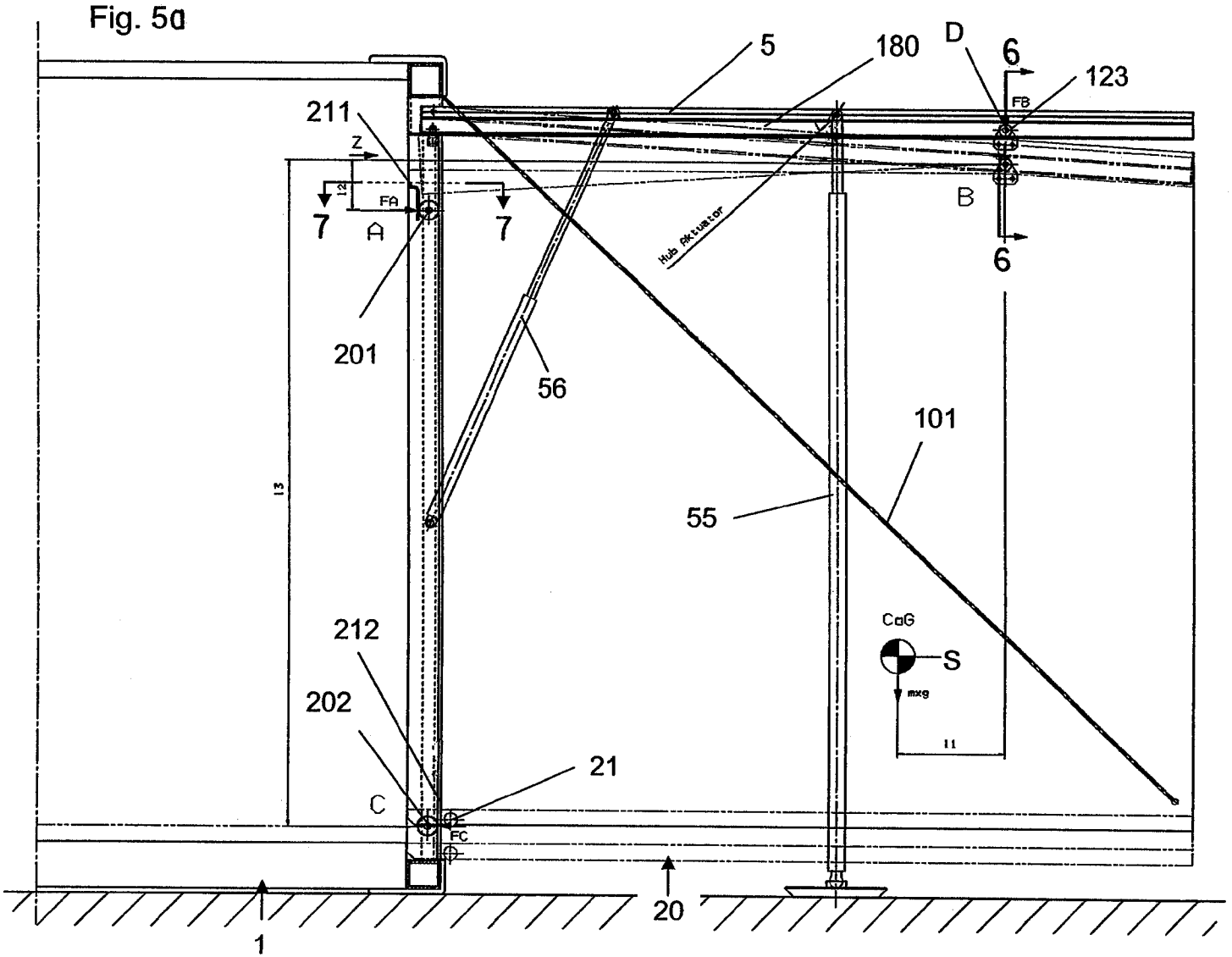
FIGS. 5*a* and 5*b* are vertical sectional views through other embodiments of the container of the present invention.
Figure 5B:
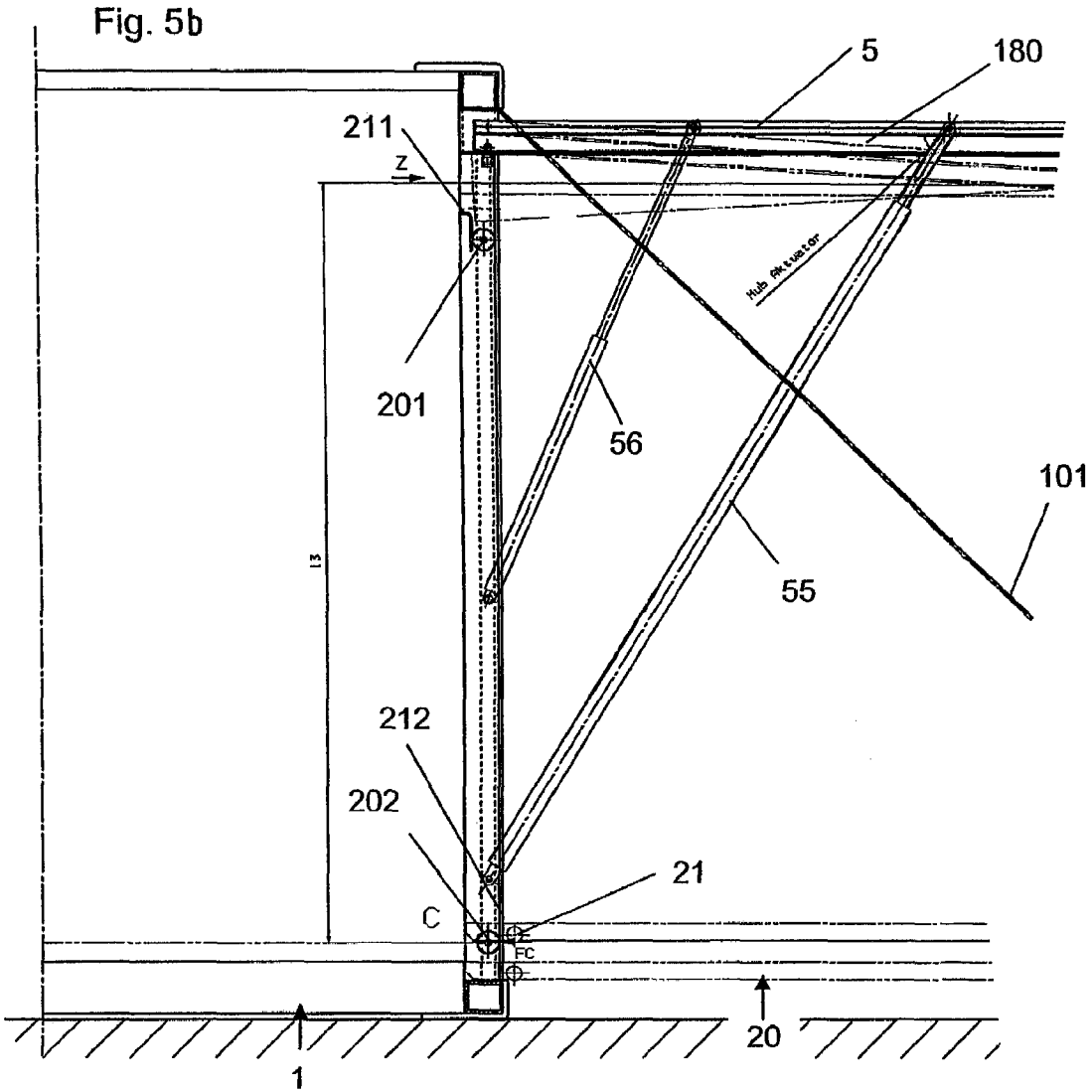
Figure 7:
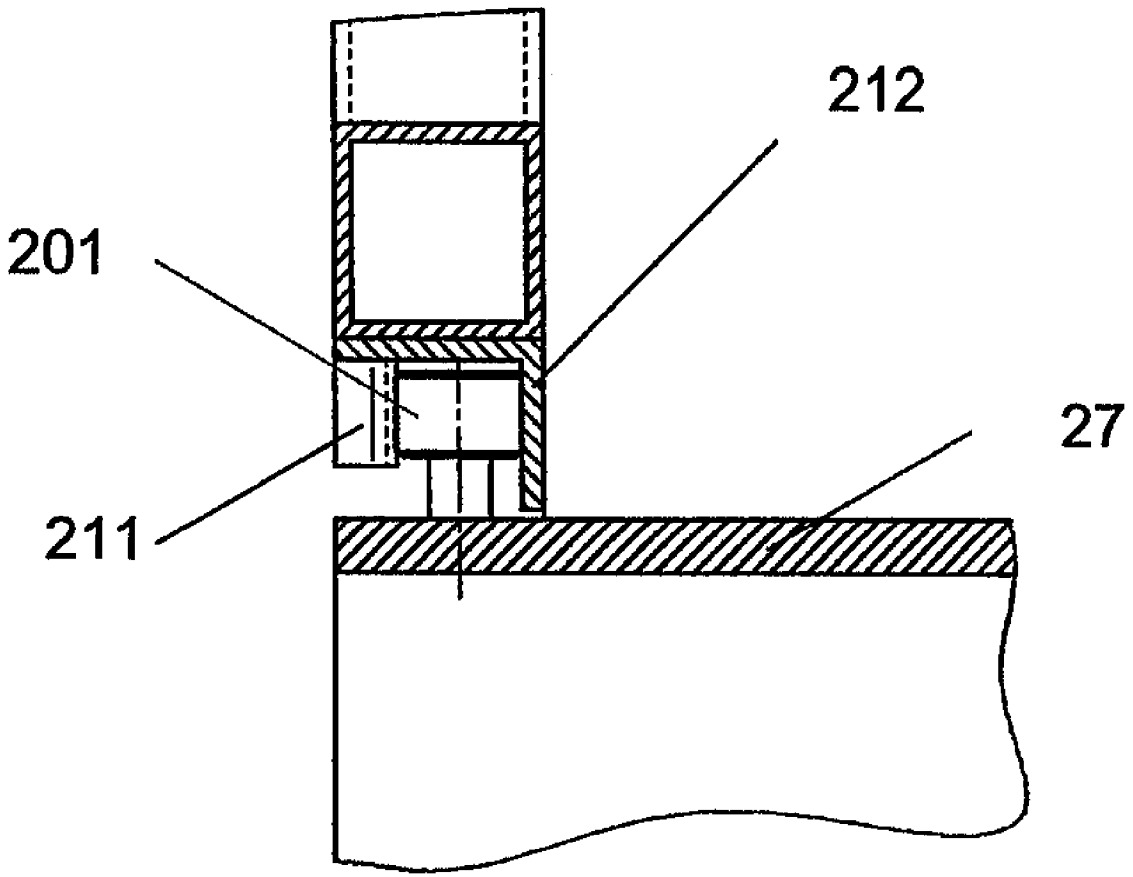
FIG. 7 is a horizontal sectional view along line 7-7 in FIG. 5.

FIGS. 5 and 7 show the rollers 201, 202, positioned on a side panel 27 of the expansion element 20. Of course, corresponding rollers are provided on the diametrically opposing side panel of an expansion element 20, and work together with a guide element and a vertical stop provided on the other side of the basic container. FIG. 7 is a horizontal sectional view along line 7-7 of FIG. 5, in which the upper roller 201 and guide element 211 and stop profile 212 are illustrated in detail. Upper roller 201 and lower roller 202 are illustrated in FIGS. 5*a*, 5*b* and 7, each in their position with expansion element 20 lowered completely.

As will be described in greater detail later with reference to FIG. 8, *a*) through *d*), the rollers 201, 202 and the guide element 211 and stop 212 associated therewith provide a statically fixed position for the expansion element 20 and can be used as a starting position for the lowering operation. In this starting position, the lower roller 202 is supported on the stop 212, and the upper roller 201 is supported on the ramp of the angular guide element, so that the tilting moment induced by the weight (center of gravity S) is absorbed around the fulcrum D.

After the expansion element 20 has been completely lowered, the hoisting device 55 can be dismounted and stowed in a niche of the basic container 1. In the telescoped and lowered state of the expansion element 20, the loads of the expansion element 20 are advantageously absorbed by the stop 212, on which both the lower and the upper roller 201, 202 are supported. Alternatively or additionally, the operating loads can be absorbed by a tension brace 101 between basic container 1 and the expansion element 20 when expansion element 20 is telescoped and lowered as illustrated in FIG. 5.

In a particularly advantageous embodiment, the tension brace 101 is implemented as a cable that is permanently attached to the diagonally opposing attachment points between an expansion element 20 and the basic container 1 (both with the expansion element retracted and with the expansion element telescoped, and in the transition phase). When the expansion element is retracted, the cable 101 is located in a niche between the side panel 27 of an expansion element 10, 20 and the basic container 1.

Figure 6:
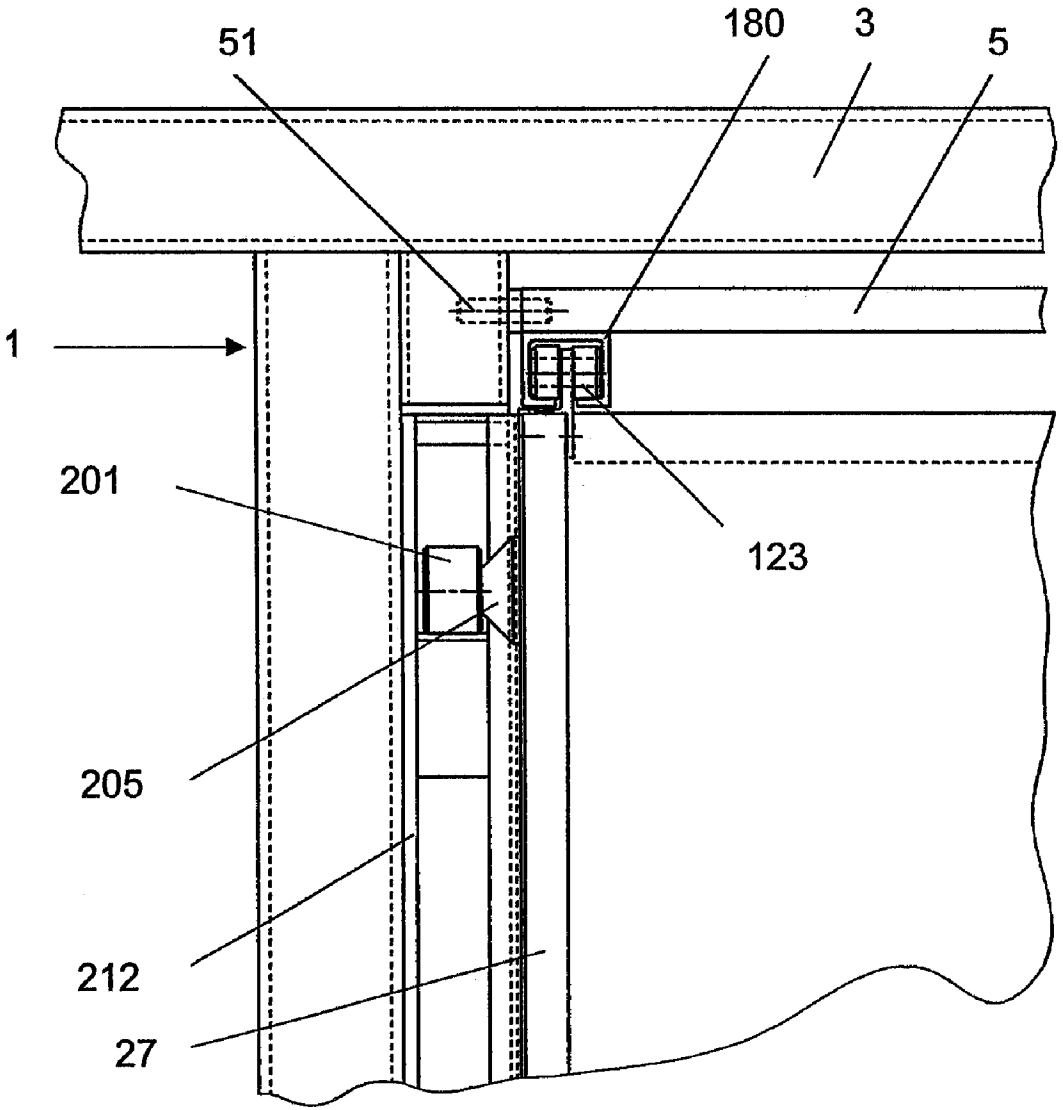
FIG. 6 is a partial view of the container shown in FIGS. 5*a* and 5*b* in direction Z in FIGS. 5*a* and 5*b;*

FIGS. 8 *a*) through *d*) show the sequence of lowering an expansion element for the embodiment of the container illustrated in FIGS. 5 through 7. In each of FIG. 8*a*) through *d*), the regions around the upper guide element 211 and the lower stop 212 are also shown enlarged in the isolated memo.

As the expansion element 20 is telescoped out of the basic container 1, it rolls on bottom rollers 21 which positioned on its bottom panel 25. The bottom rollers 21 roll on the bottom panel 15 of the larger expansion element 10 (FIG. 1), which is not located completely in the basic container 1. In addition, the expansion element 20 is guided by the roller 123 in the guide rail 180 which is attached to the raised side panel 5 where it is mounted to rotate around a horizontal axis or fulcrum point D. The raised side panel 5 is in a horizontal position during the telescoping.

Figure 8A:
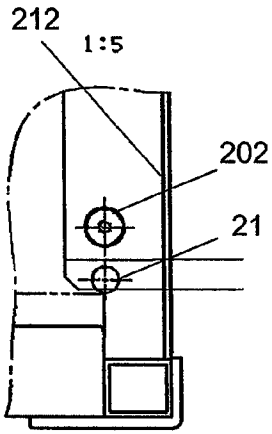
FIGS. 8 *a*) through *d*) are sketches of the sequence of lowering an expansion element according to the second embodiment of the container shown in FIGS. 5*a* and 5*b;*
Figure 8A:
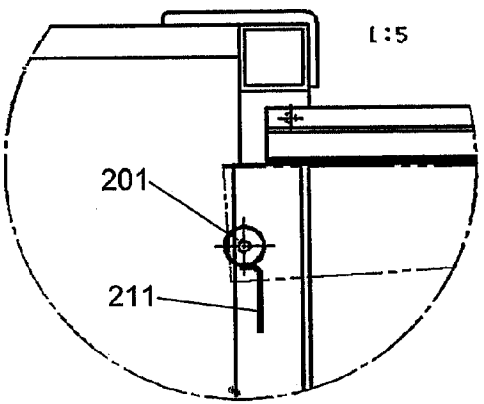
Figure 8A:
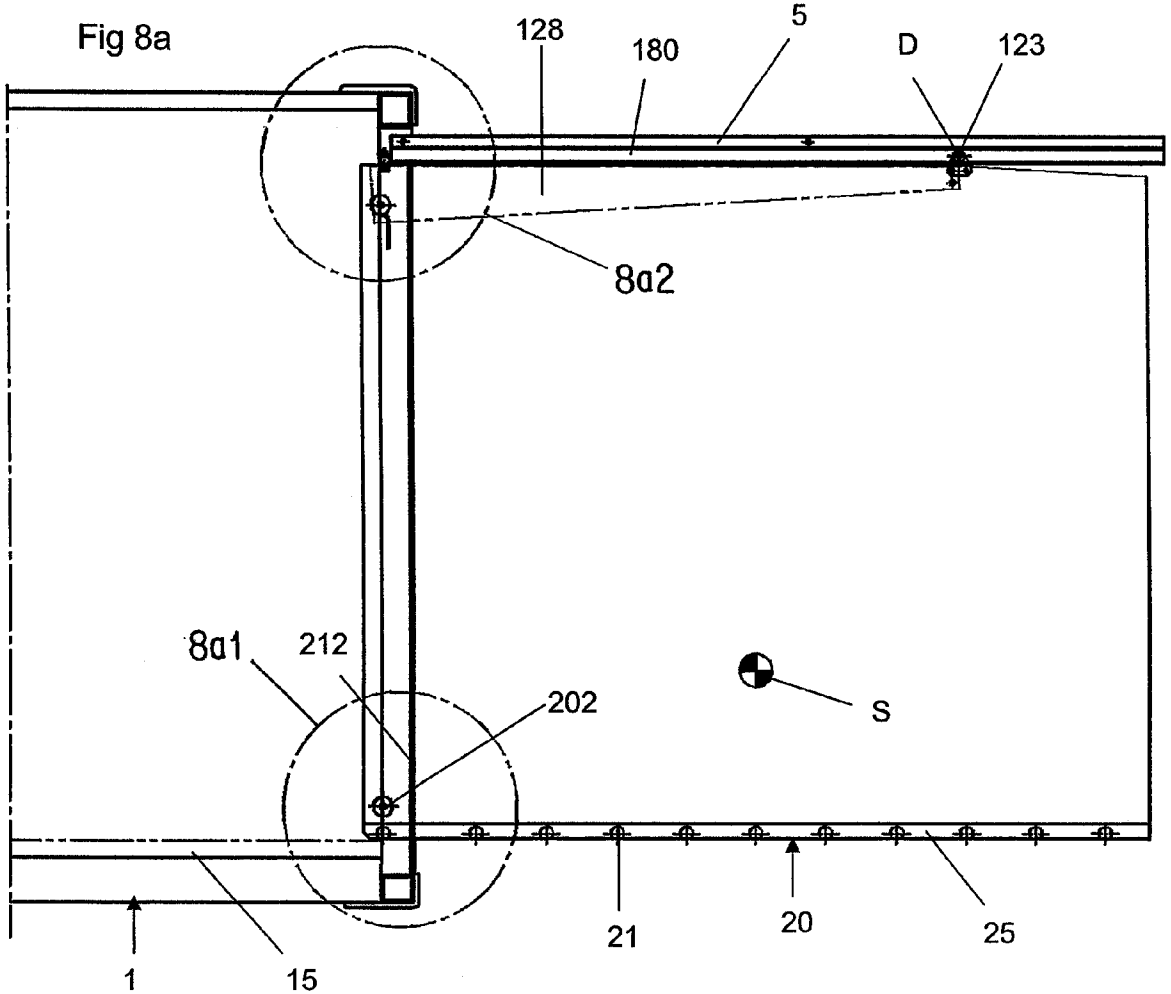
Figure 8B:
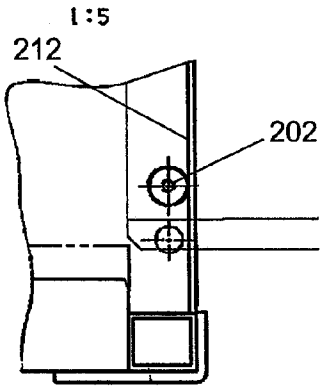
Figure 8B:
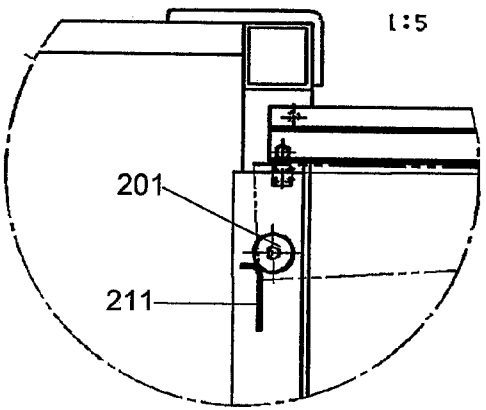
Figure 8B:
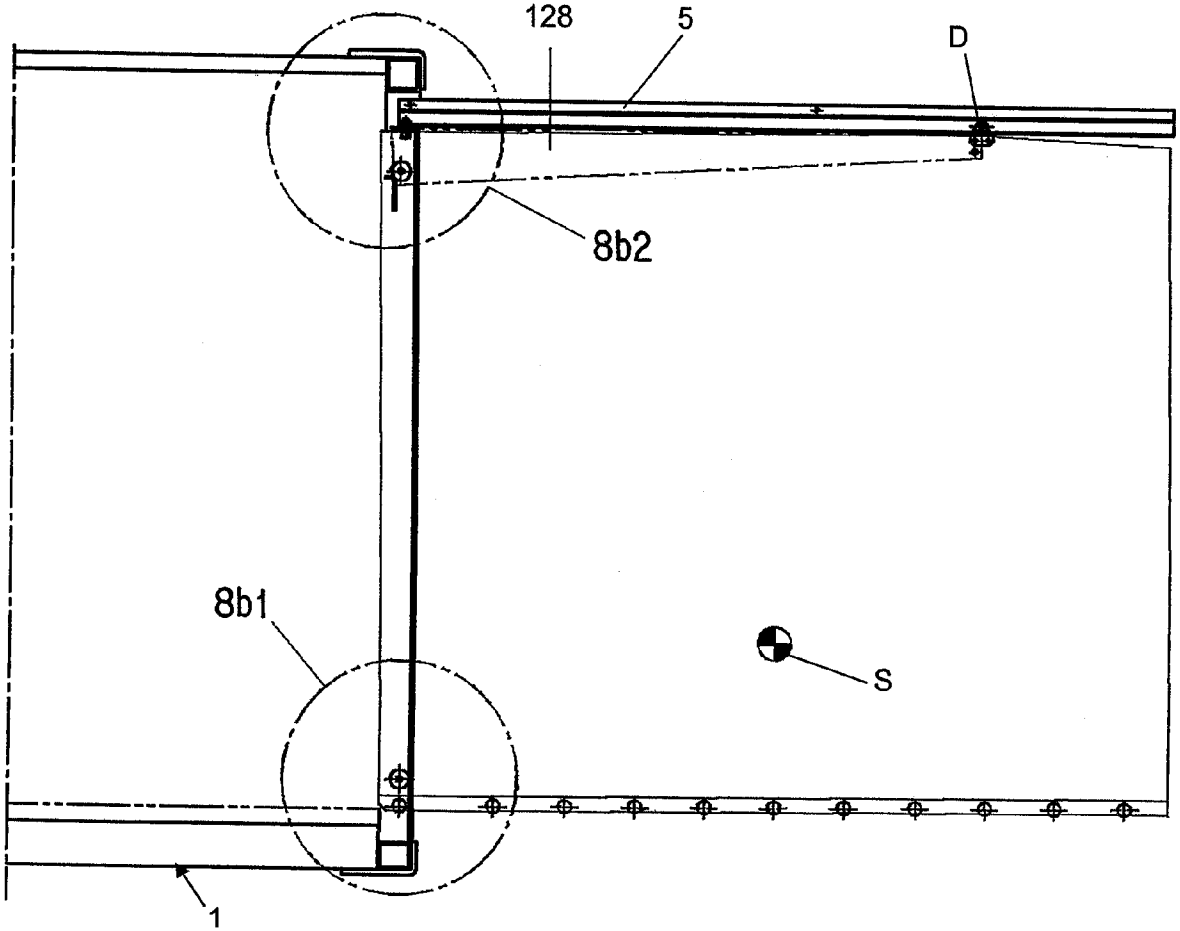

FIG. 8*a*) shows the expansion element 20 almost completely telescoped out. The last of the bottom rollers 21 has reached the outermost edge of the bottom panel 25. The load is now taken by the guide element 211 positioned on top of the basic container 1. The upper roller 201 positioned on the expansion element 20 now lies on the horizontal leg of the guide element 211.

If the expansion element 20 is telescoped out even further as seen in FIG. 8 *b*), the upper roller 201 reaches the ramp of the guide element 211 which slopes outward. Because of the torque, in relation to the fulcrum D, induced by the weight of the expansion element (center of gravity S), the upper roller 201 rolls on the ramp of the guide element 211 until the lower roller 202 positioned on the expansion element 20 stops on the vertical stop 212 of the basic container 1. The expansion element is now located in a stable, statically-fixed position (i.e. geometrically clamped), in which the roller pair 201, 202 generates a countertorque having the same absolute value as the torque induced by the weight of the expansion element 20. This stable position, which is illustrated in FIG. 8 *b*), forms the starting position for lowering the expansion element. The raised side panel 5 is still in a horizontal position as before.

Figure 8C:
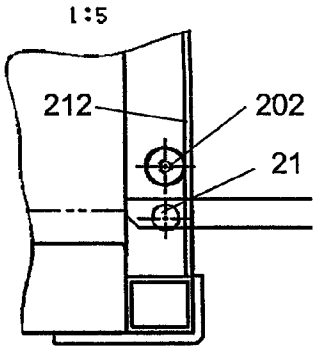
Figure 8C:
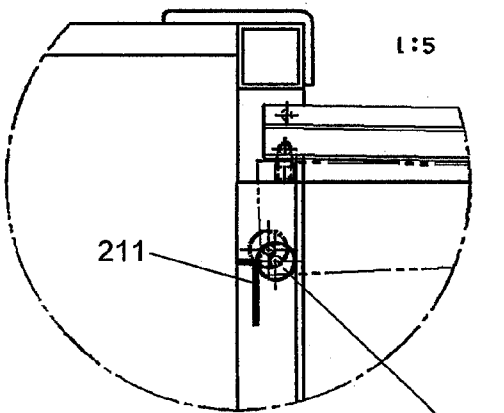
Figure 8C:
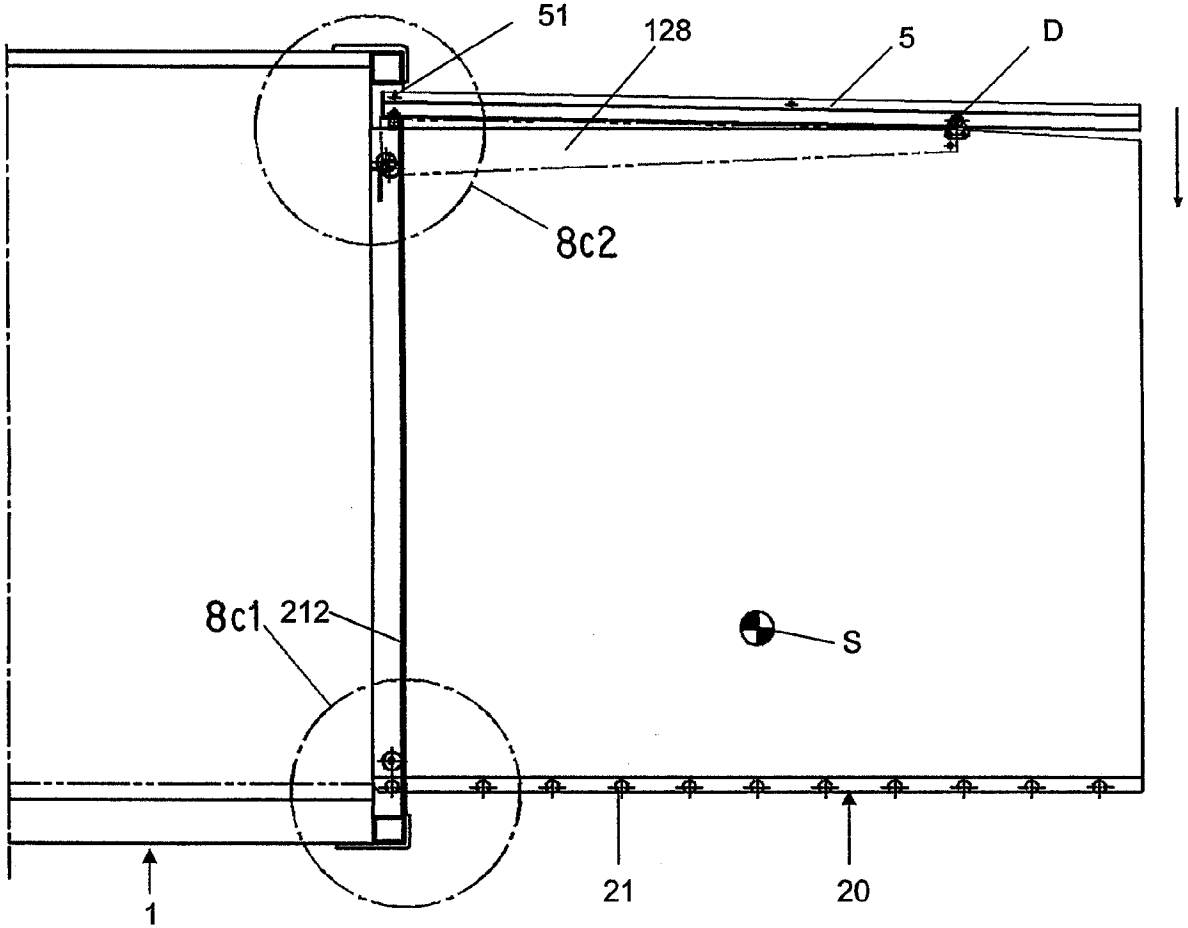
Figure 8D:
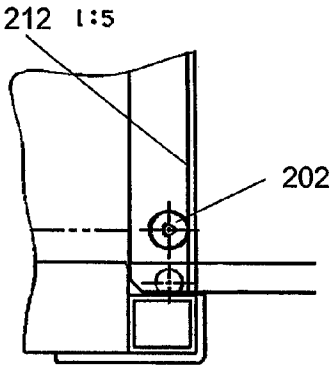
Figure 8D:
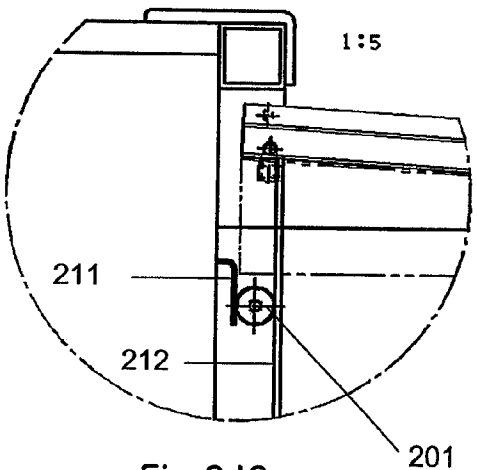
Figure 8D:
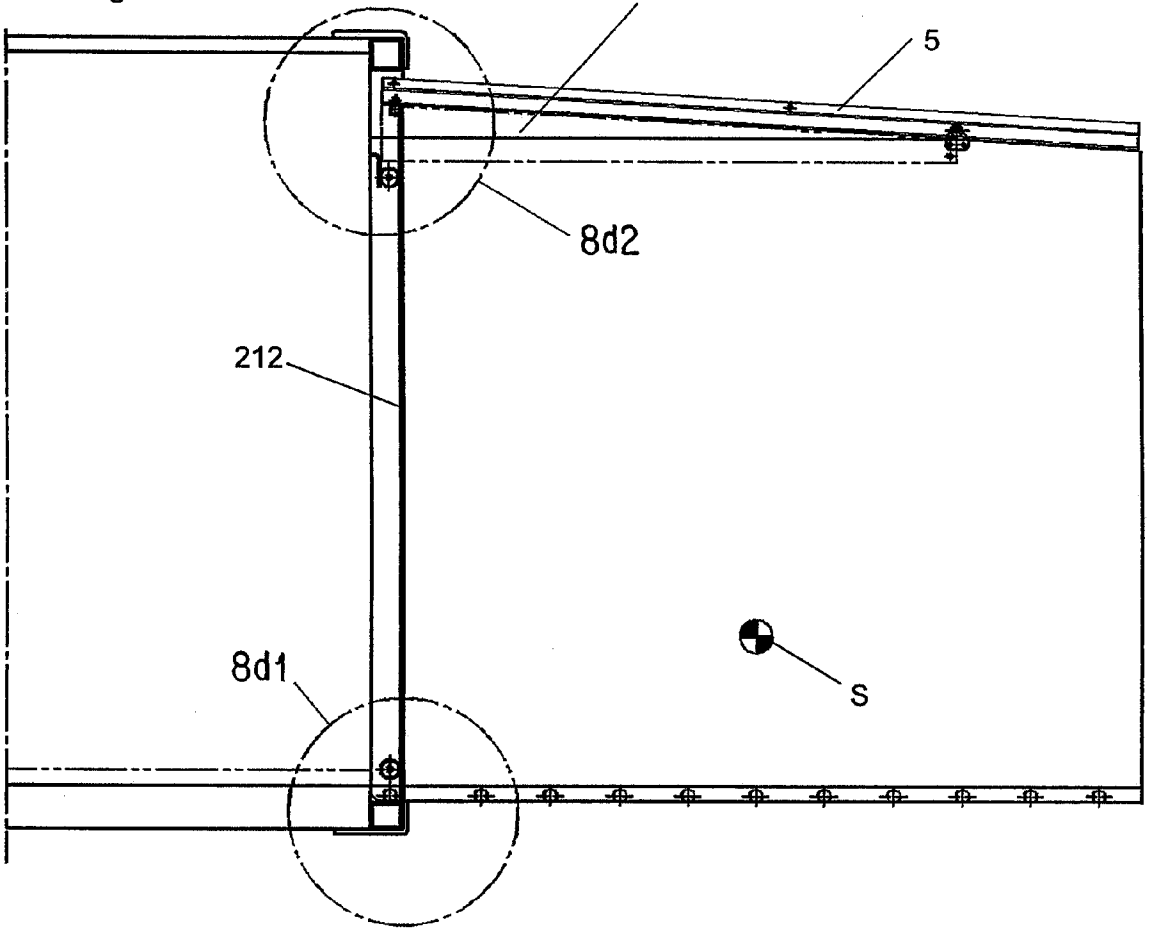

With reference to FIG. 8*c*) the expansion element 20 is now lowered by actuating the hoisting device 55 (FIG. 5) which acts on the raised side panel 5 and pivots it downward around the fulcrum 51. At the same time, the lower roller 202 rolls downward on the vertical stop 212. The upper roller 201 also rolls downward on the guide element 211, via the ramp, and then on the vertical leg of the guide element 211 until the completely lowered position of the expansion element 20 is reached as shown in FIG. 8 *d*).

Those skilled in the art will recognize that the lower stop 212 and the leg of the guide element 211 do not necessarily have to be aligned exactly vertically. Reliable lowering is possible even if these two elements cited are tilted out of the vertical. Likewise, it will also be apparent to those skilled in the art that, in order to reduce the surface pressure a single roller 201, 202 may also be replaced by a group of rollers, e.g., two or three rollers which are positioned on a shared frame. Instead of the rolling elements 201, 202, sliding elements can also be used. For example, a pin having a rectangular cross-section can be used as a sliding element, one of its surfaces being implemented as a sliding surface (e.g., using a slide coating).

The lowering movement described is completely reversible. By actuating the hoisting device 55 (i.e., extending the linear actuator), the expansion element 20 is raised until it reaches the stable position shown in FIG. 8 *b*). From this position, the expansion element 20 is retractable into the basic container 1.

Figure 1E:
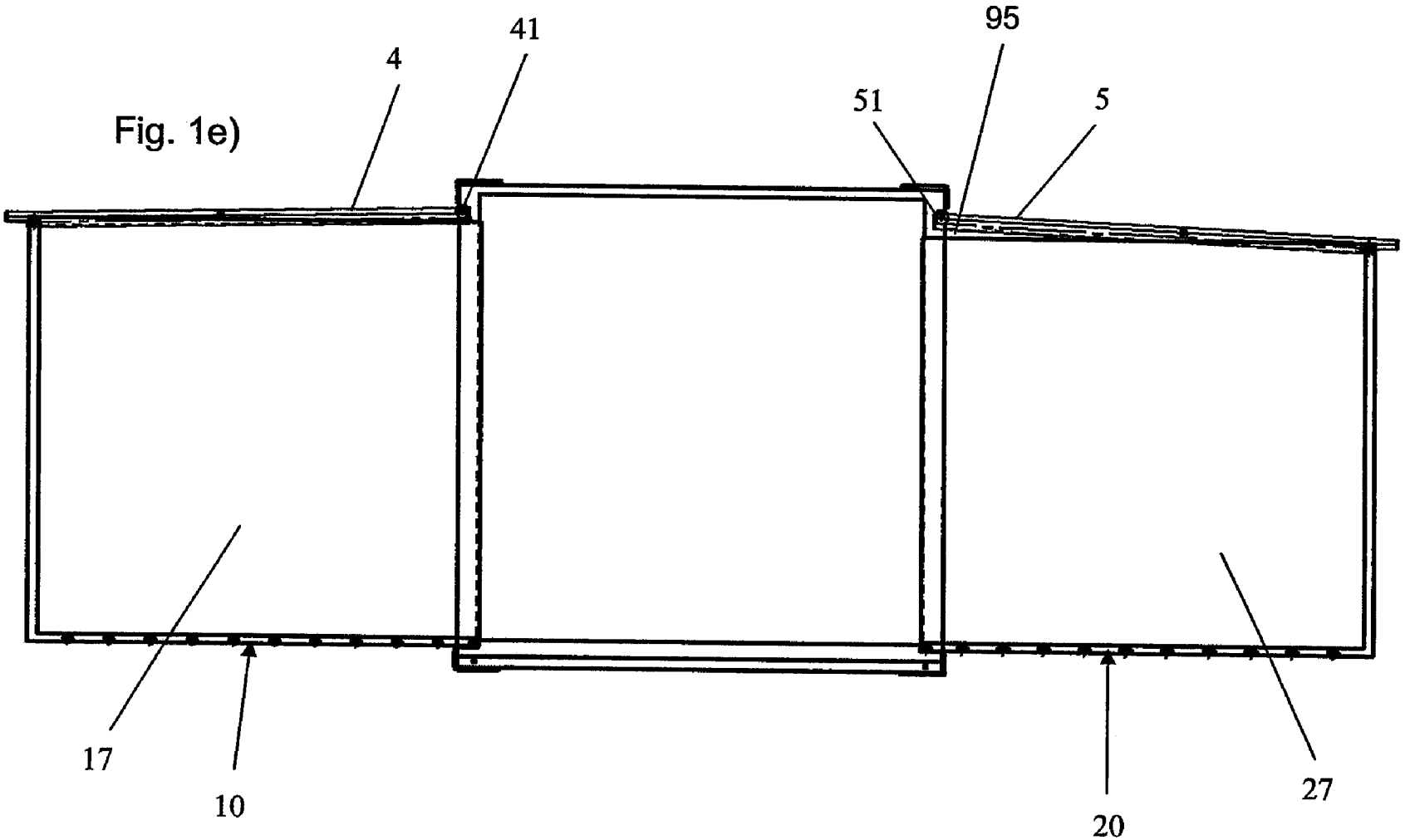
Figures 9, 9A, 9B:
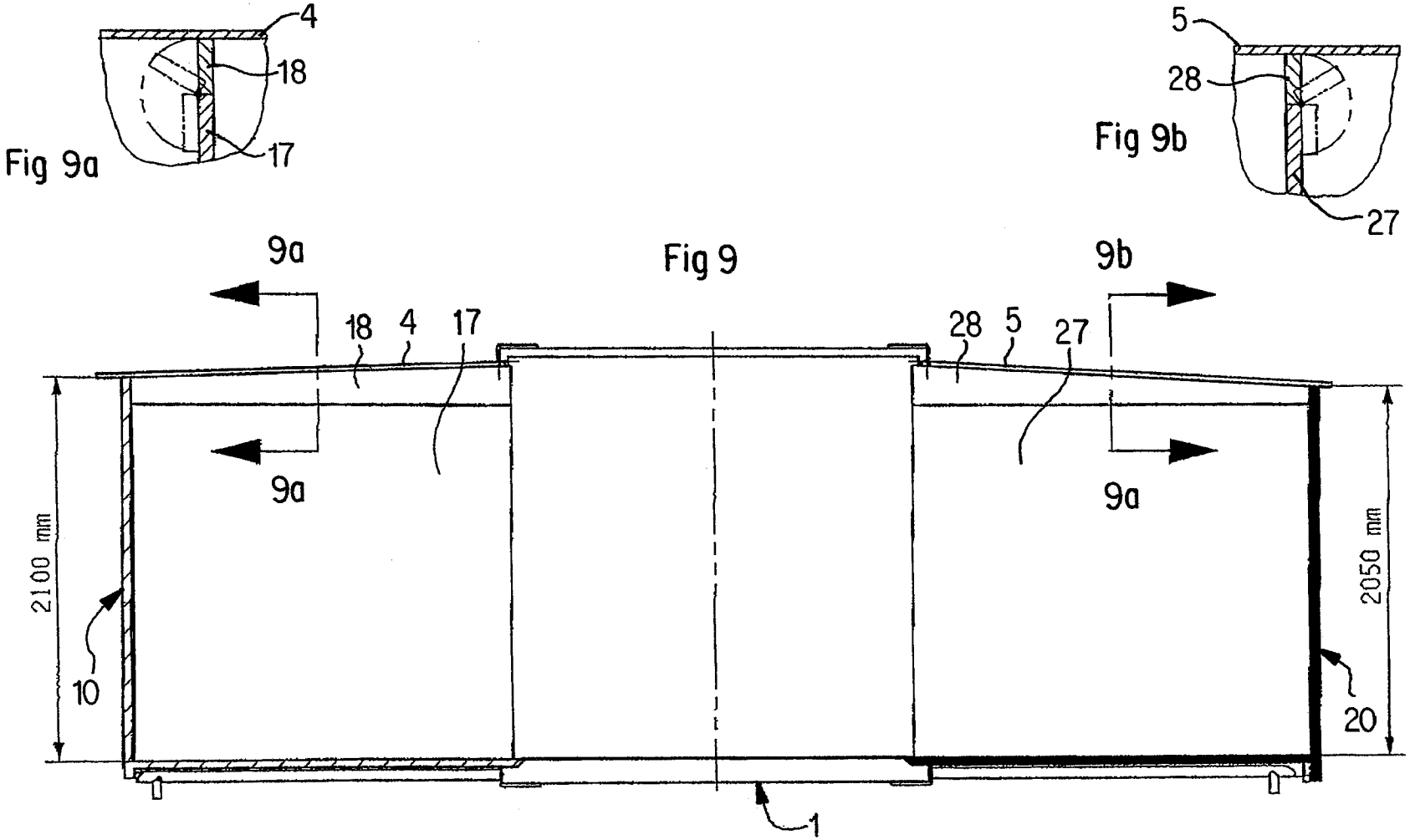
FIG. 9 is a side view of a container according to the present invention with the expansion element telescoped out and lowered, as well as additional surface elements.

After the lowering operation is concluded, trapezoidal openings 95 are formed between the upper edge of the side panel and the roof panel 4, 5 with the expansion elements 10, 20 as previously described with reference to FIG. 1*e*). To close these openings, additional trapezoidal surface elements 18, 28 may be collapsibly mounted on the upper edge of the side panels 17, 27. After the expansion elements have been completely telescoped out and lowered, they can be raised, as illustrated in FIG. 9 so that openings between the roof panel 4, 5 and the side panel 17, 27 are now closed. The unfolding process is illustrated in detail in the isolated portions taken along lines B-B and A-A of FIG. 9. Thus, a container interior is formed which is completely closed to the outside. Instead of being mounted on the upper edge of the side panels, the additional surface elements can also be collapsibly mounted on the roof panel 4, 5 of an expansion element 10, 20.

In a further embodiment, the additional surface elements can be integrated into the side panels of an expansion element, so that the side panels are implemented as double-paneled and the additional surface element is positioned between the two panels of the side panel. If necessary, the additional surface elements can be telescoped out using, for example, a spring force. For this purpose, reference is again made to FIG. 8 *a*) through FIG. 8 *d*) where an additional surface element 128 is integrated into the side panel there. When the gaps between side panel and roof panel 5 arise as the expansion element 20 is lowered, the additional surface element 128 automatically telescopes out of the side panel and closes the momentarily existing gap. As seen in FIG. 8 *a*), the additional surface element 128 is still positioned completely inside the side panel at the beginning of lowering. When the expansion element 20 is completely lowered, the additional surface element 128 is also maximally telescoped out of the side panel.

In another contemplated embodiment, the additional surface elements may be configured with double panels. For sealing purposes, gaskets, such as contact gaskets, can be provided on the additional surface elements or on the basic container or the expansion elements 10, 20. The additional surface elements 18, 28 can also be structurally separate from the container elements and shipped as separate components, which are inserted as needed.

The examples illustrated in the drawings show embodiments having exactly two expansion elements. Embodiments having exactly one or more than two expansion elements are of course also contemplated. The telescoping operation and the lowering operation take place like the processes depicted here for the individual expansion elements 10, 20.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. Variable volume container comprising:

a basic unit having a bottom panel and a roof panel;

at least one hinged side panel associated with the basic unit and rotateable about a horizontal axis;

at least one expansion element arranged to be telescoped out of the basic unit and having a bottom panel, a side open toward a front of the basic unit and a front panel opposite the open side, whereby the at least one expansion element is open toward the top and, in a telescoped state, the roof panel is formed by a raised side panel of the basic unit; and at least one hoisting device operatively associated with each of the at least one expansion element and with which the expansion element is lowered so that, after the at least one expansion element is telescoped out, the bottom panels of the at least one expansion element and of the basic unit are at the same height and also so that the at least one expansion element is arranged to be inserted back into the basic unit after being lowered, wherein the hoisting device is configured to cooperate with and lower the hinged side panel to lower and raise the at least one expansion element, and wherein the at least one expansion element has a plurality of upper and multiple lower sliding or rolling elements on an interior end thereof, and the basic unit has a plurality of guide elements operatively associated with the upper sliding or rolling elements, ramps sloping downward toward the at least one expansion element on an end thereof neighboring the at least one expansion element, and a plurality of lower stops operatively associated with the lower sliding or rolling elements, on another end thereof neighboring the at least one expansion element whereby, when the at least one expansion element is completely telescoped out of the basic container, it assumes a statically fixed starting position in which the lower sliding or rolling elements stop on a lower stop and the upper sliding or rolling elements lie on a guide element ramp.

2. Variable volume container comprising:

a basic unit having a bottom panel and a roof panel;

at least one hinged side panel associated with the basic unit and rotateable about a horizontal axis;

at least one expansion element arranged to be telescoped out of the basic unit and having a bottom panel, a side open toward a front of the basic unit and a front panel opposite the open side, whereby the at least one expansion element is open toward the top and, in a telescoped state, the roof panel is formed by a raised side panel of the basic unit; and at least one hoisting device operatively associated with each of the at least one expansion element and with which the expansion element is lowered so that, after the at least one expansion element is telescoped out, the bottom panels of the at least one expansion element and of the basic unit are at the same height and also so that the at least one expansion element is arranged to be inserted back into the basic unit after being lowered, wherein the hoisting device is configured to cooperate with and lower the hinged side panel to lower and raise the at least one expansion element, and wherein the at least one expansion element has a plurality of upper and multiple lower sliding or rolling elements on an interior end thereof, wherein the basic unit has a plurality of guide elements operatively associated with the upper sliding or rolling elements on an end thereof neighboring the at least one expansion element, the guide elements comprising horizontally and vertically aligned legs, and a plurality of lower stops operatively associated with the lower sliding or rolling elements, on another end thereof neighboring the at least one expansion element whereby the at least on expansion element, when completely telescoped out of the basic unit, assumes a statically fixed starting position in which the lower sliding or rolling elements stop on a lower stop and the upper sliding or rolling elements abut a vertically aligned leg of a guide element.

* * * * *

UNITED STATES PATENT AND TRADEMARK OFFICE

CERTIFICATE OF CORRECTION

PATENT NO. : 7,658,037 B2
APPLICATION NO. : 10/834136
DATED : February 9, 2010
INVENTOR(S) : Bucher et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1273 days.

Signed and Sealed this

Thirtieth Day of November, 2010

David J. Kappos

David J. Kappos
*Director of the United States Patent and Trademark Office*